US009944112B2

(12) United States Patent
Furuhata et al.

(10) Patent No.: US 9,944,112 B2
(45) Date of Patent: Apr. 17, 2018

(54) MEMBER ADHERING DECORATION METHOD

(71) Applicant: MIMAKI ENGINEERING CO., LTD., Nagano (JP)

(72) Inventors: Tomotaka Furuhata, Nagano (JP); Nobutaka Matsunaga, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 521 days.

(21) Appl. No.: 14/418,079

(22) PCT Filed: Jul. 30, 2013

(86) PCT No.: PCT/JP2013/070629
§ 371 (c)(1),
(2) Date: Jan. 29, 2015

(87) PCT Pub. No.: WO2014/021331
PCT Pub. Date: Feb. 6, 2014

(65) Prior Publication Data

US 2015/0298495 A1 Oct. 22, 2015

(30) Foreign Application Priority Data

Aug. 1, 2012 (JP) ..... 2012-171501
Aug. 27, 2012 (JP) ..... 2012-187002

(51) Int. Cl.
*B44C 3/02* (2006.01)
*B05D 1/36* (2006.01)
(Continued)

(52) U.S. Cl.
CPC ..... *B44C 3/02* (2013.01); *B05D 1/36* (2013.01); *B05D 1/38* (2013.01); *B05D 5/06* (2013.01); *B44C 1/17* (2013.01)

(58) Field of Classification Search
CPC ..... B47C 3/02
See application file for complete search history.

(56) References Cited

U.S. PATENT DOCUMENTS 2,566,735 A * 9/1951 Lepie ..... C03C 17/42 156/89.24
8,128,994 B1 * 3/2012 Folck ..... A63B 53/12 427/270

(Continued)

FOREIGN PATENT DOCUMENTS

CN 201200874 Y * 3/2009
JP 59-142181 8/1984

(Continued)

OTHER PUBLICATIONS

"International Search Report (Form PCT/ISA/210)", dated Oct. 15, 2013, with English translation thereof, pp. 1-4, in which nine of the listed references (JP2000-158639, JP04-201446, JP11-131213, JP2005-066833, JP10-250299, JP2004-130585, JP59-142181, JP2006-016246 and JP62-246887) were cited.

(Continued)

*Primary Examiner* — Cachet I Sellman
(74) *Attorney, Agent, or Firm* — JCIPRNET

(57) ABSTRACT

A member adhering decoration method capable of enhancing processability in comparison with conventional methods is provided. The member adhering decoration method for decorating a target object (11) by adhering a decoration member (13*a*), which is a member for decoration, onto the object (11) includes: a primer layer formation step for ink jet printing a tack-containing coating, which is a coating that contains a tack, onto the object (11) during curing or drying to form a primer layer (12) on the object (11) by using the tack-containing coating; and a decoration layer formation step for applying the decoration member (13*a*) onto the primer layer (12) formed by the primer layer formation step (Continued)

to thereby form a decoration layer (13) composed of the decoration member (13*a*) on the primer layer (12) by using the tack of the primer layer (12).

9 Claims, 15 Drawing Sheets

(51) Int. Cl.

| | |
|---|---|
| ***B44C 1/17*** | (2006.01) |
| ***B05D 1/38*** | (2006.01) |
| ***B05D 5/06*** | (2006.01) |

(56) References Cited

U.S. PATENT DOCUMENTS

| | | | | |
|---|---|---|---|---|
| 2004/0242003 | A1* | 12/2004 | Murayama | B24B 7/228 438/690 |
| 2005/0103182 | A1* | 5/2005 | Spurgeon | B41J 3/407 84/291 |
| 2008/0152920 | A1* | 6/2008 | Carlston | B29C 70/86 428/411.1 |
| 2011/0053340 | A1* | 3/2011 | Hattori | C08G 77/12 438/424 |

FOREIGN PATENT DOCUMENTS

| | | | | |
|---|---|---|---|---|
| JP | 62-246887 | | 10/1987 | |
| JP | S63126799 | | 5/1988 | |
| JP | 04-201446 | | 7/1992 | |
| JP | 10-250299 | | 9/1998 | |
| JP | 11-131213 | | 5/1999 | |
| JP | 2000-158639 | | 6/2000 | |
| JP | 2000158639 | A * | 6/2000 | |
| JP | 2004-130585 | | 4/2004 | |
| JP | 2004-358766 | | 12/2004 | |
| JP | 2005-066833 | | 3/2005 | |
| JP | 2005128462 | | 5/2005 | |
| JP | 2006-016246 | | 1/2006 | |
| JP | 2007-276120 | | 10/2007 | |
| JP | 3174669 | | 3/2012 | |
| WO | WO 9728012 | A1 * | 8/1997 | B44C 1/17 |
| WO | WO-2013151442 | A1 * | 10/2013 | B41J 11/0015 |

OTHER PUBLICATIONS

"Office Action of Japan Counterpart Application" with English translation, dated Jul. 5, 2016, p. 1-5, in which the listed references were cited.

"Office Action of China Counterpart Application" with English translation thereof, dated Aug. 23, 2016, p. 1-14.

* cited by examiner

MEMBER ADHERING DECORATION METHOD

CROSS-REFERENCE TO RELATED APPLICATION

This application is a 371 application of the International PCT application serial no. PCT/JP2013/070629, filed on Jul. 30, 2013, which claims priority benefits of Japan Patent Application No. 2012-171501, filed on Aug. 1, 2012, and Japan Patent Application No. 2012-187002, filed on Aug. 27, 2012. The entirety of each of the above-mentioned patent applications is hereby incorporated by references herein and made a part of this specification.

TECHNICAL FIELD

The present invention relates to a member adhering decoration method that decorates a target object by adhering a decoration member being a member for decoration, onto the target object.

BACKGROUND ART

In the related art, as a printing method, printing methods such as a screen printing and an ink jet printing are known. Here, the ink jet printing is more excellent in workability compared to the screen printing.

In the related art, as a member adhering decoration method using the ink jet printing, a method that ink jet prints ink on a target object and thereafter causes gold powder to adhere onto this ink just before the ink on the target object is dry to touch (see Patent Documents 1 and 2).

PRIOR ART DOCUMENTS

Patent Documents

Patent Document 1: JP 2004-358766 A
Patent Document 2: JP 2007-276120 A

SUMMARY OF THE INVENTION

Problems to be Solved by the Invention

However, in the member adhering decoration method of the related art, since a period necessary for causing the gold powder to adhere onto the ink is short, there is such a problem that it is difficult to cause the gold powder to adhere onto the ink at an appropriate time.

For example, in a case where the gold powder is adhered onto the ink at a time point when the ink on the target object is not dry to touch, such a problem rises that it is difficult for the ink covered with the gold powder to dry. Here, the ink for the ink jet has very low viscosity compared to ink for the screen printing. Accordingly, when the ink for the ink jet is difficult to dry, the ink on the target object spreads on the target object due to its own weight or wettability, whereby a shape of an edge of the ink on the target object is deformed, as a result of which such a problem also rises that it is difficult to obtain highly accurate decoration using the gold powder.

On the other hand, in a case where the gold powder is adhered onto the ink at a time point when the ink on the target object is completely dry to touch, such a problem rises that the gold powder does not adhere to the ink.

Thus, the present invention aims to provide a member adhering decoration method that can improve workability compared to the related art.

Solutions to the Problems

A member adhering decoration method of the present invention is a method that decorates a target object by adhering a decoration member being a member for decoration onto the target object, the method including: a primer layer forming step for ink jet printing a tack-containing coating, which is a coating that contains a tack, onto the target object during curing or drying to form a primer layer on the target object by using the tack-containing coating; and a decoration layer forming step for applying a decoration layer onto the primer layer formed in the primer layer forming step to thereby form a decoration layer composed of the decoration member on the primer layer by using the tack of the primer layer.

According to this configuration, since the member adhering decoration method of the present invention causes the decoration member to adhere onto the primer layer by the tack (viscosity) of the primer layer after the primer layer is completely cured or dried, management of time for causing the decoration member to adhere can be facilitated compared to the related art. That is, the member adhering decoration method of the present invention can improve the workability compared to the related art.

Further, in the member adhering decoration method of the present invention, the decoration layer forming step may be a step for forming the decoration layer on the primer layer by the tack of the primer layer by sowing the decoration member on the primer layer.

According to this configuration, since the member adhering decoration method of the present invention forms the decoration layer by a simple work of sowing the decoration member on the primer layer, the workability can be improved.

Further, the member adhering decoration method of the present invention may include a primer layer heating step for heating the primer layer on which the decoration layer is formed in the decoration layer forming step, to a temperature equal to or greater than a glass transition point of the primer layer.

According to this configuration, since the member adhering decoration method of the present invention can eliminate the tack by changing a property of the primer layer by heating the primer layer to the temperature equal to or greater than the glass transition point of the primer layer, adhesion of dust to the primer layer by the tack of the primer layer can be prevented. Accordingly, the member adhering decoration method of the present invention can prevent a member adhering type decorated object generated by causing the decoration member to adhere onto the target object from fouling.

Further, the member adhering decoration method of the present invention may include a decoration layer pressing step for pressing the decoration layer against the primer layer after the primer layer heating step, at a time point when the temperature of the primer layer is equal to or greater than the glass transition point.

According to this configuration, since the member adhering decoration method of the present invention can cause the decoration layer to sink into the primer layer by pressing the decoration layer against the primer layer at a time point when the temperature of the primer layer is equal to or greater than the glass transition point of the primer layer, a possibility that the decoration layer be peeled from the primer layer can be reduced even when the tack of the primer layer is lost.

Further, the member adhering decoration method of the present invention may include a protective layer forming step for forming a protective layer that protects the decoration layer formed in the decoration layer forming step, on the decoration layer.

According to this configuration, since the member adhering decoration method of the present invention protects the decoration layer by the protective layer, durability of the member adhering type decorated object generated by causing the decoration member to adhere to the target object can be improved. Further, since the member adhering decoration method of the present invention covers the primer layer having tack with the protective layer, the method can prevent the member adhering type decorated object from fouling with dust adhering onto the primer layer.

Further, in the member adhering decoration method of the present invention, the protective layer forming step may be a step of forming the protective layer by ink jet printing.

According to this configuration, the member adhering decoration method of the present invention can form the protective layer easily compared to a case of manually forming the protective layer.

Further, in the member adhering decoration method of the present invention, the protective layer forming step may be a step of forming the protective layer having light permeability by color ink jet printing.

According to this configuration, the member adhering decoration method of the present invention not only can improve the durability of the member adhering type decorated object by protecting the decoration layer by the protective layer, but also can newly add bright decoration providing a synergistic effect of the decoration layer of the decoration member and a color protective layer having the light permeability to the member adhering type decorated object.

Further, in the member adhering decoration method of the present invention, print data used in the ink jet printing in the primer layer forming step and print data used in the ink jet printing in the protective layer forming step may be print data in which outer shapes of figures to be printed are identical.

According to this configuration, in the member adhering decoration method of the present invention, since the outer shape of the primer layer formed by the ink jet printing in the primer layer forming step and the outer shape of the protective layer formed by the ink jet printing in the protective layer forming step become identical, the decoration layer formed on the primer layer and the color protective layer having the light permeability can be overlapped with high accuracy.

Further, in the member adhering decoration method of the present invention, the protective layer forming step may be a step of forming the protective layer by dripping a curing composite resin in a heap.

According to this configuration, the member adhering decoration method of the present invention can newly add decoration of a heap of the curing composite resin to the member adhering type decorated object by using the protective layer protecting the decoration layer.

Further, in the member adhering decoration method of the present invention, the decoration member may be fiber.

According to this configuration, the member adhering decoration method of the present invention can provide decoration that not only can be visually appealing but also can give tactile perception, on the target object by using the fiber being the decoration member.

Further, in the member adhering decoration method of the present invention, the tack-containing coating may be ultraviolet curing ink, and the primer layer forming step may be a step of forming the primer layer on the target object by UV ink jet printing the tack-containing coating on the target object.

According to this configuration, since the member adhering decoration method of the present invention forms the primer layer of the tack-containing coating on the target object by UV ink jet printing the tack-containing coating on the target object, time to curing of the primer layer can be shortened. Accordingly, the member adhering decoration method of the present invention can shorten the time to completion of the member adhering type decorated object generated by causing the decoration member to adhere onto the target object.

Effect of the Invention

The member adhering decoration method of the present invention can improve workability compared to the related art.

EMBODIMENTS OF THE INVENTION

Embodiments of the present invention will be described hereinbelow with reference to the drawings.

First Embodiment

Firstly, a configuration of a member adhering type decorated object according to the present embodiment will be described.

Figure 1A:
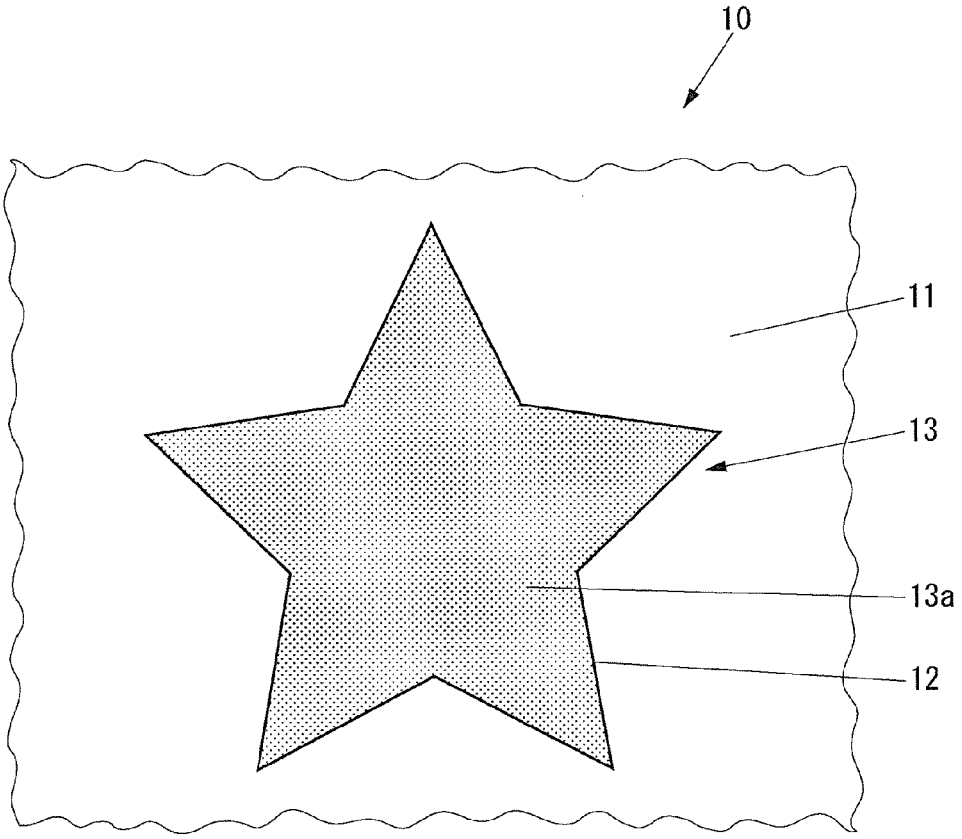
FIG. 1A is a front diagram of a part of a member adhering type decorated object according to a first embodiment of the present invention.
Figure 1B:
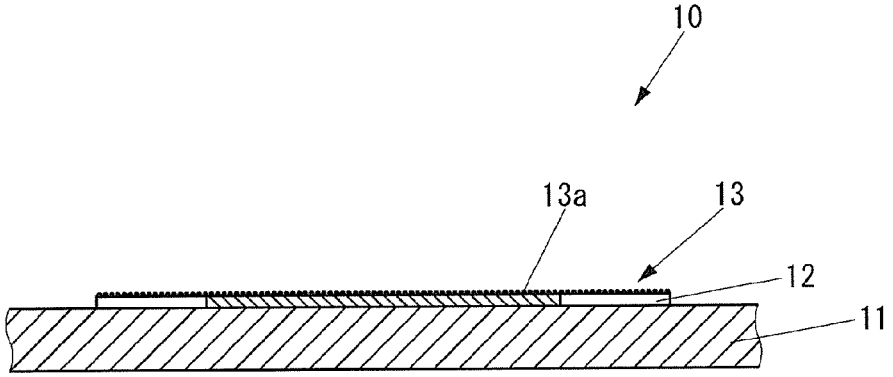
FIG. 1B is a bottom surface cross sectional diagram of a part of the member adhering type decorated object shown in FIG. 1A.

FIG. 1A is a front diagram of a part of a member adhering type decorated object 10 according to the present embodiment. FIG. 1B is a bottom surface cross sectional diagram of a part of the member adhering type decorated object 10 shown in FIG. 1A.

As shown in FIG. 1A and FIG. 1B, the member adhering type decorated object 10 is an object generated by sowing a decoration member 13*a* being a member for decoration on a target object 11. The member adhering type decorated object 10 includes the target object 11, a primer layer 12 formed on the target object 11, and a decoration layer 13 formed on the primer layer 12.

The target object 11 is, for example, formed of a material such as a composite resin. The target object 11 is, for example, an object such as a cover for a smart phone.

The primer layer 12 is formed by UV ink jet printing tack-containing coating being ultraviolet curing ink having tack (viscosity) upon curing on the target object 11. The tack-containing coating is, for example, colorless and transparent ink. The tack-containing coating is, for example, formed of acrylate as a binder resin.

The decoration layer 13 is formed by causing the decoration member 13*a* to adhere onto the primer layer 12 by the tack of the primer layer 12.

Next, a configuration of an ink jet printer used in manufacture of the member adhering type decorated object 10 will be described.

Figure 2:
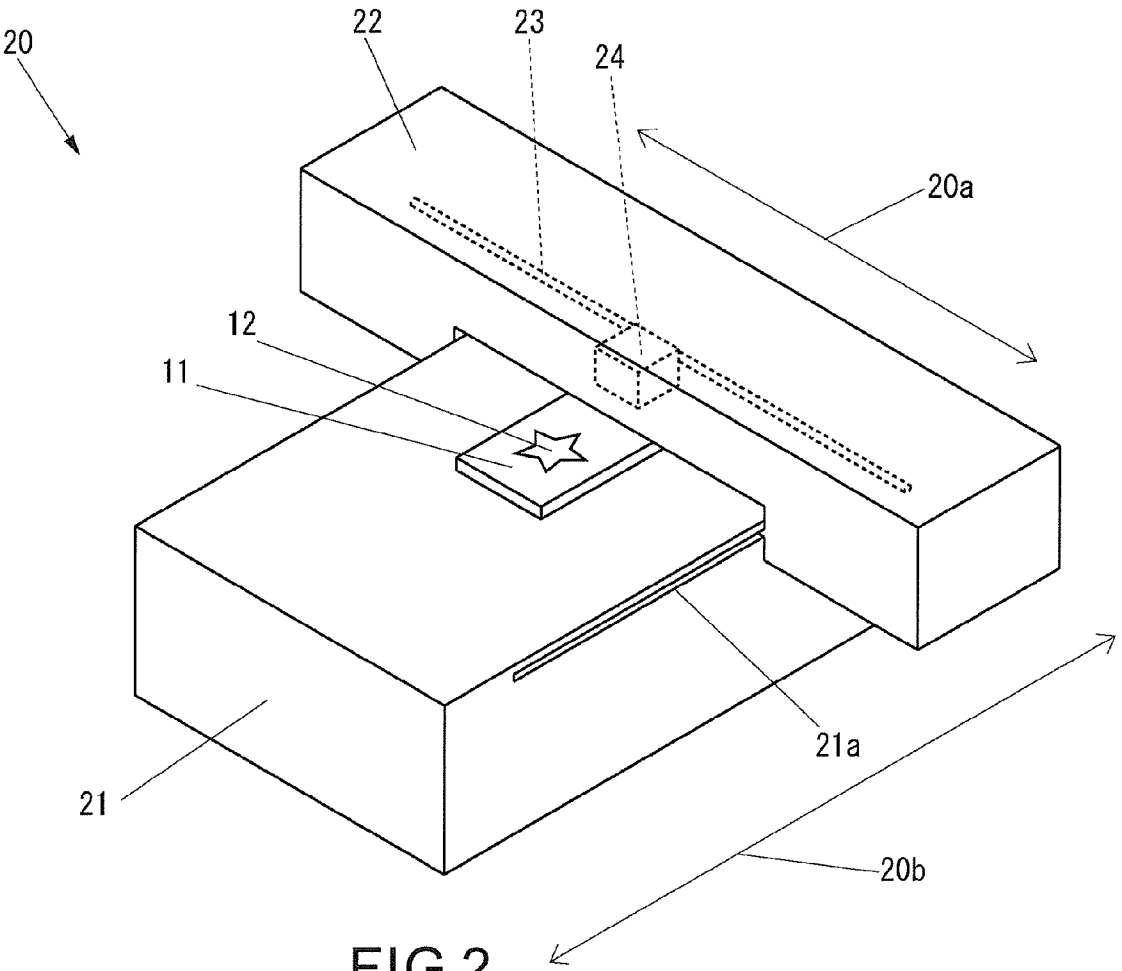
FIG. 2 is a perspective diagram of an ink jet printer used in manufacture of the member adhering type decorated object shown in FIG. 1A and FIG. 1B.

FIG. 2 is a perspective diagram of an ink jet printer 20 used in manufacture of the member adhering type decorated object 10.

As shown in FIG. 2, the ink jet printer 20 includes a table 21 on which the target object 11 is to be mounted, and a main body 22 extending in a main scanning direction shown by an arrow 20*a*.

The table 21 includes a guiding mechanism 21*a*, which extends in a sub scanning direction shown by an arrow 20*b* and supports the main body 22 movably in the sub scanning direction shown by the arrow 20*b*, on either side in the main scanning direction shown by the arrow 20*a*.

The main body 22 includes a guide rail 23 extending in the main scanning direction shown by the arrow 20*a*, and a carriage 24 supported by the guide rail 23 movably in the main scanning direction shown by the arrow 20*a*. The carriage 24 is equipped with a recording head (not shown) for discharging droplets of ultraviolet curing liquid toward the table 21, and an LED (Light Emitting Diode) (not shown) for irradiating the table 21 with ultraviolet ray for curing the ultraviolet curing liquid discharged from the recording head.

Next, a member adhering decoration method that decorates the target object 11 by sowing the decoration member 13*a* on the target object 11, that is, a method of manufacturing the member adhering type decorated object 10 will be described.

1. Primer Layer Forming Step

A worker fixes the target object 11 at a predetermined position on the table 21 of the ink jet printer 20, and instructs the ink jet printer 20 to record an image based on arbitrary print data on the target object 11 with the tack-containing coating.

The ink jet printer 20 that has received the instruction from the worker moves the carriage 24 relative to the table 21 along the guide rail 23 in the main scanning direction shown by the arrow 20*a*, and moves the main body 22 relative to the table 21 along the guiding mechanism 21*a* in the sub scanning direction shown by the arrow 20*b*. That is, the ink jet printer 20 moves the carriage 24 relative to the target object 11 fixed on the table 21 in accordance with the print data. Then, the ink jet printer 20 discharges the tack-containing coating from the recording head on the carriage 24 toward the target object 11 fixed on the table 21, and irradiates the tack-containing coating discharged on the target object 11 with the ultraviolet ray by the LED on the carriage 24. That is, the ink jet printer 20 forms the primer layer 12 of the tack-containing coating on the target object 11 by UV ink jet printing the tack-containing coating in a form of the image based on the print data on the target object 11.

Figure 3A:
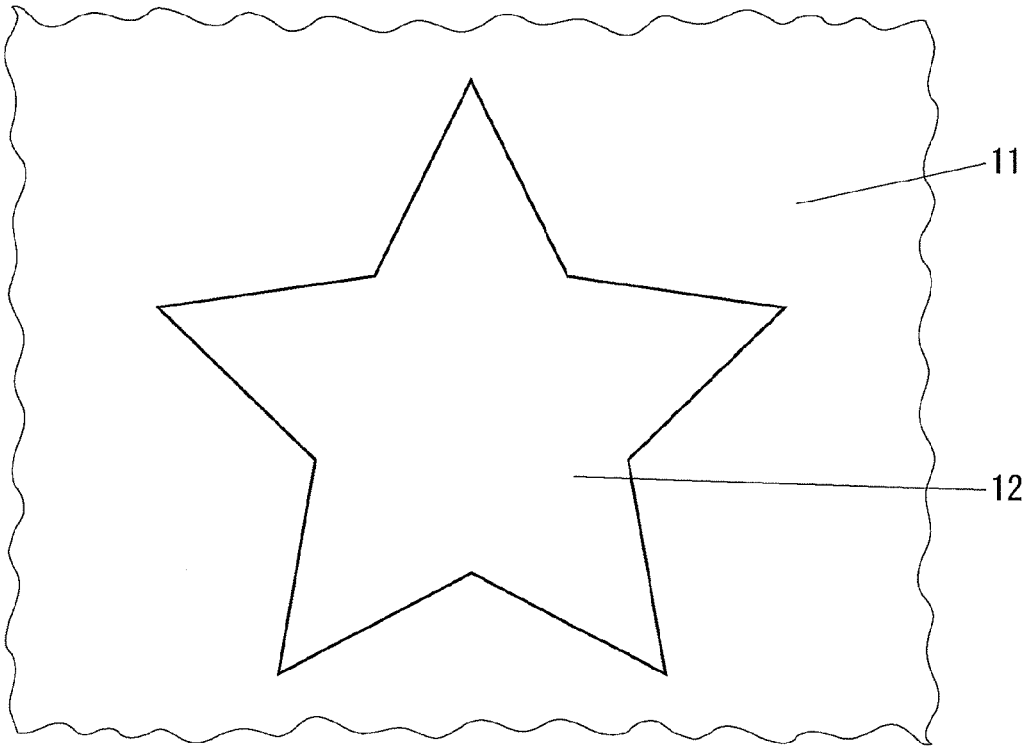
FIG. 3A is a front diagram of a part of a target object shown in FIG. 1A and FIG. 1B in which a primer layer is formed.
Figure 3B:
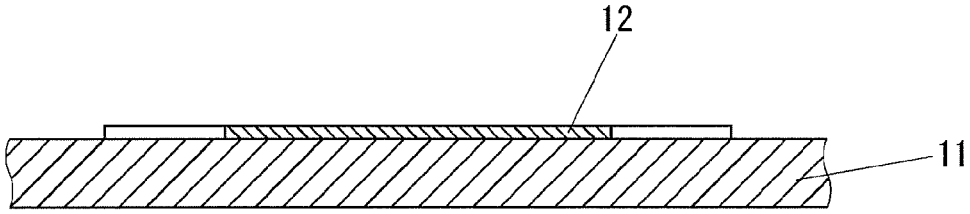
FIG. 3B is a bottom surface cross sectional diagram of a part of the target object shown in FIG. 3A.

FIG. 3A is a front diagram of a part of the target object 11 in which the primer layer 12 is formed. FIG. 3B is a bottom surface cross sectional diagram of a part of the target object 11 shown in FIG. 3A.

The target object 11 in which the primer layer 12 is formed in the primer layer forming step becomes as shown in FIG. 3A and FIG. 3B, for example.

2. Decoration Layer Forming Step

Next, the worker detaches the target object 11 from the table 21 of the ink jet printer 20, and forms the decoration layer 13 of the decoration member 13*a* on the primer layer 12 by the tack of the primer layer 12 by manually sowing the decoration member 13*a* on the primer layer 12 formed on the target object 11.

The target object 11 in which the decoration layer 13 is formed in the decoration layer forming step is completed as the member adhering type decorated object 10 as shown in FIG. 1A and FIG. 1B, for example.

As described above, since the member adhering decoration method according to the present embodiment causes the decoration member 13*a* to adhere onto the primer layer 12 by the tack (viscosity) of the primer layer 12 after having completely cured the primer layer 12, management of time for causing the decoration member 13*a* to adhere can be facilitated compared to the related art. That is, the member adhering decoration method according to the present embodiment can improve the workability compared to the related art.

Further, since the member adhering decoration method according to the present embodiment causes the decoration member 13*a* to adhere onto the primer layer 12 after having completely cured the primer layer 12, even when the primer layer 12 is formed of tack-containing coating for ink jet having very low viscosity before curing compared to the ink for screen printing, the primer layer 12 on the target object 11 does not spread on the target object 11 by its own weight or wettability after the decoration member 13*a* is sown on the primer layer 12. That is, in the member adhering decoration method according to the present embodiment, a shape of an edge of the primer layer 12 on the target object 11 is fixed even after the decoration member 13*a* is sown on the primer layer 12. Accordingly, the member adhering decoration method according to the present embodiment can obtain highly accurate decoration using the decoration member 13*a*.

Further, since the member adhering decoration method according to the present embodiment forms the primer layer 12 of the tack-containing coating on the target object 11 by UV ink jet printing the tack-containing coating on the target object 11, the time to the curing of the primer layer 12 can be shortened. Accordingly, the member adhering decoration method according to the present embodiment can shorten the time to the completion of the member adhering type decorated object 10 generated by causing the decoration member 13*a* to adhere to the target object 11.

Note that the tack-containing coating is ultraviolet curing ink in the present embodiment; however, the tack-containing coating may be curing ink other than the ultraviolet curing ink, that is, a type of ink that cures by reaction of the components. For example, the tack-containing coating may be two-pack curing ink.

Further, the tack-containing coating is curing ink in the present embodiment; however, the tack-containing coating may be a type of ink of which solvent dries, such as an organic solvent type of ink, and aqueous ink. That is, the tack-containing coating may be ink that has the tack upon drying. Even though the member adhering decoration method according to the present embodiment is configured to cause the decoration member 13*a* to adhere onto the primer layer 12 by the tack of the primer layer 12 after having completely dried the primer layer 12, the management of time for causing the decoration member 13*a* to adhere can be facilitated compared to the related art, and the workability can be improved compared to the related art.

As the decoration member 13*a*, for example, metallic powder such as gold powder, luminous powder, isinglass powder, powdery fiber and the like may be used.

The luminous powder that is a mineral substance is hard, and therefore is difficult to be refined. Due to this, even when the luminous powder is mixed in ink to be used in printing by the ink jet printer, it is difficult in terms of the size for the luminous powder to be discharged from the nozzle of the ink jet printer. Further, since the luminous powder that is a mineral substance is heavy, the luminous powder easily precipitates in ink when being mixed in the ink, and again it is difficult for the luminous powder to be discharged from the nozzle of the ink jet printer. However, since the member adhering decoration method according to the present embodiment causes the decoration member 13*a* to adhere onto the primer layer 12 formed by the UV ink jet printing by the ink jet printer 20, the decoration using the luminous powder can be provided on the target object 11 even when the decoration member 13*a* is the luminous powder.

The isinglass powder appears to glitter like a pearl by the diffused reflection, and therefore needs to have a certain gain size or more so as to glitter like a pearl. Due to this, even when the isinglass powder is mixed in ink to be used in printing by the ink jet printer, it is difficult in terms of the size for the isinglass powder to be discharged from the nozzle of the ink jet printer. However, since the member adhering decoration method according to the present embodiment causes the decoration member 13*a* to adhere onto the primer layer 12 formed by the UV ink jet printing by the ink jet printer 20, the decoration using the isinglass powder can be provided on the target object 11 even when the decoration member 13*a* is the isinglass powder.

When the powdery fiber is mixed in ink to be used in printing by the ink jet printer, it is difficult for the powdery fiber to appear on a surface of the printed ink. However, since the member adhering decoration method according to the present embodiment causes the decoration member 13*a* to adhere onto the primer layer 12 formed by the UV ink jet printing by the ink jet printer 20, decoration using the fiber can be provided on a surface of the member adhering type decorated object 10 even when the decoration member 13*a* is the powdery fiber. That is, when the decoration member 13*a* is the fiber, the member adhering decoration method according to the present embodiment can provide decoration that not only can be visually appealing but also can give tactile perception, on the target object 11 by using the fiber being the decoration member 13*a*. When the decoration member 13*a* is the fiber, the member adhering decoration method according to the present embodiment can provide decoration that has, for example, a texture like a peach skin or a texture like suede on the target object 11 by using the fiber being the decoration member 13*a*.

Second Embodiment

A configuration of a member adhering type decorated object according to the present embodiment is similar to the configuration of the member adhering type decorated object 10 according to the first embodiment (see FIG. 1A and FIG. 1B), and therefore the description thereof is omitted.

A member adhering decoration method that decorates a target object 11 by sowing a decoration member 13*a* on the target object 11, that is, a method of manufacturing the member adhering type decorated object according to the present embodiment will be described.

1. Primer Layer Forming Step

A worker forms a primer layer 12 of tack-containing coating on the target object 11 by printing by an ink jet printer 20, in a similar manner to the first embodiment.

2. Decoration Layer Forming Step

Next, the worker forms a decoration layer 13 of the decoration member 13*a* on the primer layer 12 by the tack of the primer layer 12 by sowing the decoration member 13*a* on the primer layer 12 formed on the target object 11, in a similar manner to the first embodiment.

3. Primer Layer Heating Step

Next, the worker place the target object 11 in which the primer layer 12 and the decoration layer 13 are formed in a device for heating, or the like, and heats the target object 11 to a temperature that is equal to or greater than a glass transition point of the primer layer 12. That is, the primer layer 12 on which the decoration layer 13 is formed in the decoration layer forming step is heated to the temperature that is equal to or greater than the glass transition point of the primer layer 12, itself.

4. Decoration Layer Pressing Step

Figure 4A:
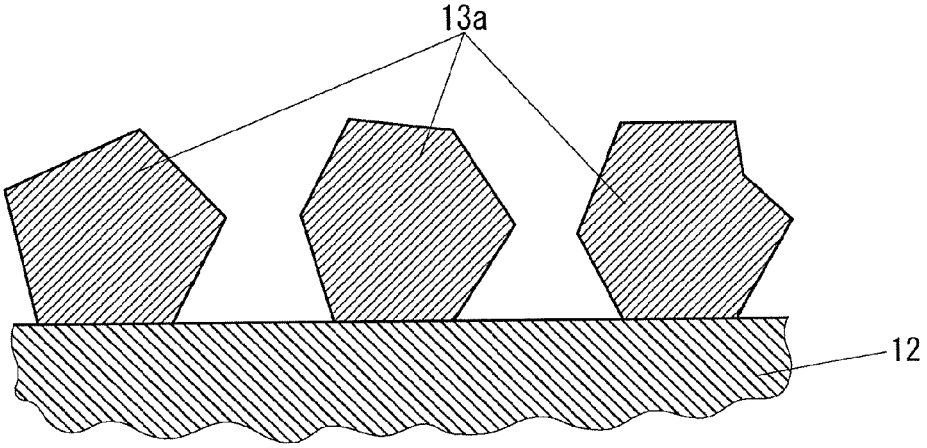
FIG. 4A is a bottom surface cross sectional diagram of a part of a member adhering type decorated object according to a second embodiment of the present invention, and is a diagram before execution of a decoration layer pressing step.
Figure 4B:
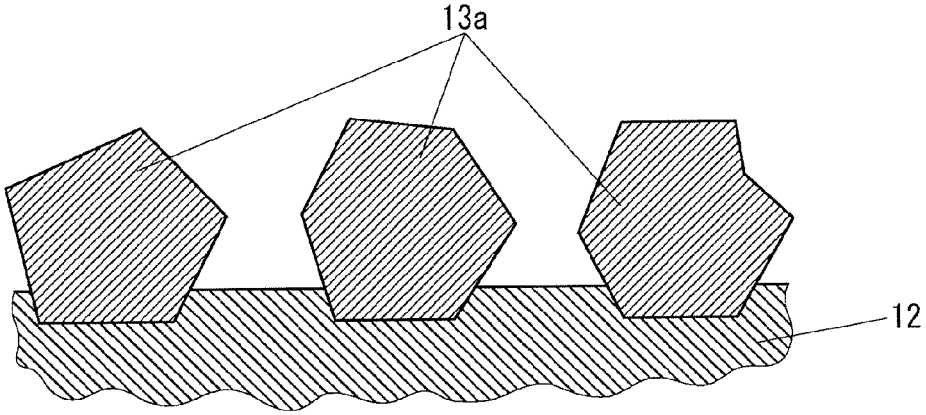
FIG. 4B is a bottom surface cross sectional diagram of a part of the member adhering type decorated object shown in FIG. 4A, and is a diagram after the execution of the decoration layer pressing step.

Next, the worker presses the decoration layer 13 against the primer layer 12 at a time point when the temperature of the primer layer 12 is equal to or greater than the glass transition point of the primer layer 12, itself. Accordingly, the decoration member 13*a* that has adhered to the surface of the primer layer 12 as shown in FIG. 4A before the execution of the decoration layer pressing step becomes in a state of being sunk into the primer layer 12 as shown in FIG. 4B after the execution of the decoration layer pressing step.

The member adhering type decorated object according to the present embodiment is completed as described above.

As described above, since the member adhering decoration method according to the present embodiment causes the decoration member 13*a* to adhere onto the primer layer 12 by the tack (viscosity) of the primer layer 12 after having completely cured the primer layer 12, management of time for causing the decoration member 13*a* to adhere can be facilitated compared to the related art. That is, the member adhering decoration method according to the present embodiment can improve the workability compared to the related art.

Further, since the member adhering decoration method according to the present embodiment can eliminate the tack by changing a property of the primer layer 12 by heating the primer layer 12 to the temperature that is equal to or greater than the glass transition point of the primer layer 12, adhesion of dust to the primer layer 12 by the tack of the primer layer 12 can be prevented. Accordingly, the member adhering decoration method according to the present embodiment can prevent the member adhering type decorated object according to the present embodiment from fouling.

Further, since the member adhering decoration method according to the present embodiment can cause the decoration layer 13 to sink into the primer layer 12 by pressing the primer layer 12 against the decoration layer 13 at the time point when the temperature of the primer layer 12 is equal to or greater than the glass transition point of the primer layer 12, a possibility that the decoration layer 13 be peeled from the primer layer 12 can be reduced even when the tack of the primer layer 12 is lost.

Note that, as the tack-containing coating, arbitrary ink such as ultraviolet curing ink and an organic solvent type of ink can be used.

Further, as the decoration member 13*a*, for example, metallic powder such as gold powder, luminous powder, isinglass powder, powdery fiber and the like can be used.

Third Embodiment

Firstly, a configuration of a member adhering type decorated object according to the present embodiment will be described.

Note that, as for a configuration similar to the configuration of the member adhering type decorated object 10 according to the first embodiment (see FIG. 1A and FIG. 1B) among the configurations of the member adhering type decorated object according to the present embodiment, the same reference numerals as those in the configuration of the member adhering type decorated object 10 will be given and a detailed description thereof will be omitted.

Figure 5A:
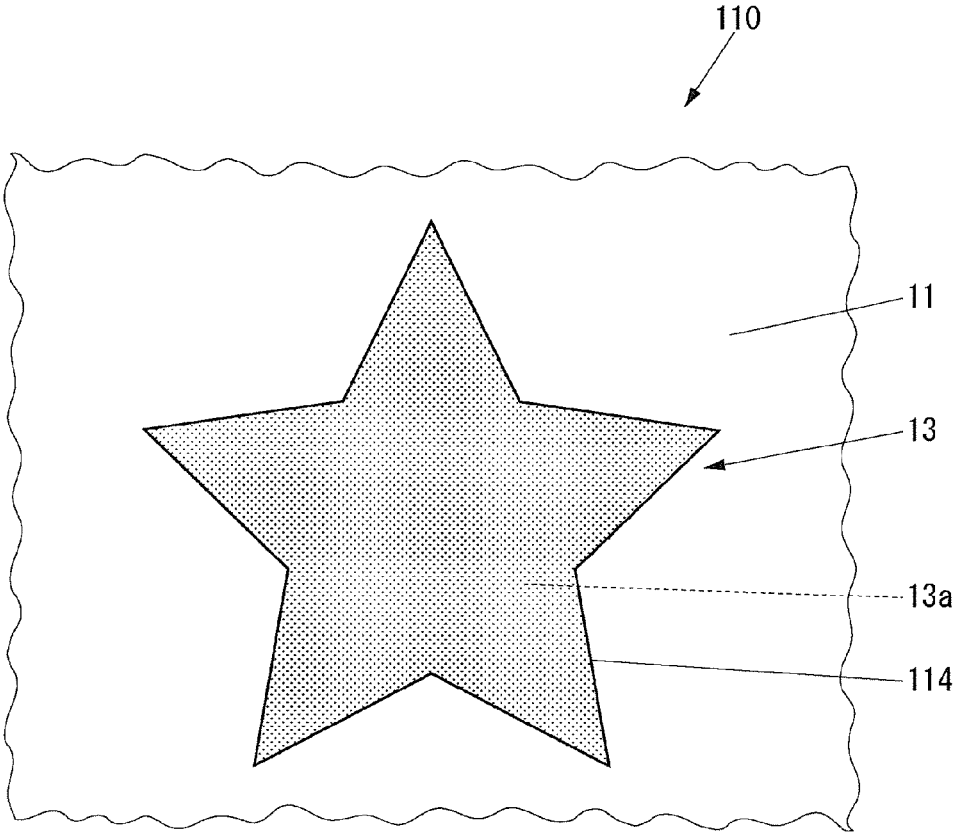
FIG. 5A is a front diagram of a part of a member adhering type decorated object according to a third embodiment of the present invention.
Figure 5B:
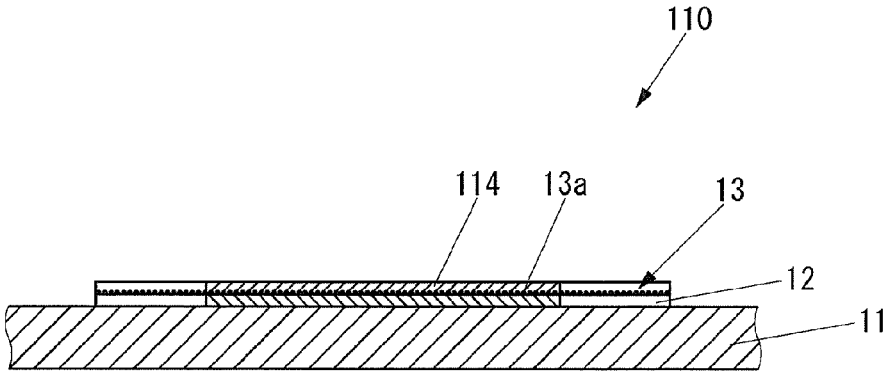
FIG. 5B is a bottom surface cross sectional diagram of a part of the member adhering type decorated object shown in FIG. 5A.

FIG. 5A is a front diagram of a part of a member adhering type decorated object 110 according to the present embodiment. FIG. 5B is a bottom surface cross sectional diagram of a part of the member adhering type decorated object 110 shown in FIG. 5A.

As shown in FIG. 5A and FIG. 5B, a configuration of the member adhering type decorated object 110 is similar to a configuration in which the member adhering type decorated object 10 includes a protective layer 114 for protecting a decoration layer 13.

The protective layer 114 is formed by UV ink jet printing ultraviolet curing ink on the decoration layer 13. This ink is, for example, colorless and transparent ink.

Next, a member adhering decoration method that decorates a target object 11 by sowing a decoration member 13*a* on the target object 11, that is, a method of manufacturing the member adhering type decorated object 110 will be described.

1. Primer Layer Forming Step

A worker forms a primer layer 12 of tack-containing coating on the target object 11 by the printing by an ink jet printer 20, in a similar manner to the first embodiment.

2. Decoration Layer Forming Step

Next, the worker forms the decoration layer 13 of the decoration member 13*a* on the primer layer 12 by the tack of the primer layer 12 by sowing the decoration member 13*a* on the primer layer 12 formed on the target object 11, in a similar manner to the first embodiment.

3. Protective Layer Forming Step

Next, the worker fixes the target object 11 in which the decoration layer 13 is formed at a predetermined position on a table 21 of the ink jet printer 20, and instructs the ink jet printer 20 to record an image based on the print data identical to print data used in the above-described primer layer forming step on the target object 11 with the ultraviolet curing ink.

The ink jet printer 20 moves a carriage 24 relative to the target object 11 fixed on the table 21 in accordance with the print data, as described above. Then, the ink jet printer 20 discharges the ultraviolet curing ink from a recording head on the carriage 24 toward the target object 11 fixed on the table 21, and irradiates the ultraviolet curing ink discharged on the target object 11 with the ultraviolet ray by the LED on the carriage 24. That is, the ink jet printer 20 forms the protective layer 114 of the ultraviolet curing ink on the decoration layer 13 by UV ink jet printing the ultraviolet curing ink in a form of the image based on the print data on the decoration layer 13.

The target object 11 in which the protective layer 114 is formed in the protective layer forming step is completed as the member adhering type decorated object 110 as shown in FIG. 5A and FIG. 5B, for example.

As described above, since the member adhering decoration method according to the present embodiment causes the decoration member 13*a* to adhere onto the primer layer 12 by the tack (viscosity) of the primer layer 12 after having completely cured the primer layer 12, management of time for causing the decoration member 13*a* to adhere can be facilitated compared to the related art. That is, the member adhering decoration method according to the present embodiment can improve the workability compared to the related art.

Further, since the member adhering decoration method according to the present embodiment forms the primer layer 12 of the tack-containing coating on the target object 11 by UV ink jet printing the tack-containing coating on the target object 11, the time to the curing of the primer layer 12 can be shortened. Accordingly, the member adhering decoration method according to the present embodiment can shorten the time to the completion of the member adhering type decorated object 110 generated by causing the decoration member 13*a* to adhere to the target object 11.

Further, since the member adhering decoration method according to the present embodiment protects the decoration layer 13 by the protective layer 114, durability of the member adhering type decorated object 110 can be improved.

Further, since the member adhering decoration method according to the present embodiment covers the primer layer 12 having tack with the protective layer 114, the method can prevent the member adhering type decorated object 110 from fouling with dust adhering onto the primer layer 12.

Further, since the member adhering decoration method according to the present embodiment forms the protective layer 114 by ink jet printing, the protective layer 114 can easily be formed compared to a case of manually forming the protective layer 114 by the worker.

In the member adhering type decorated object 110 appearance of the decoration layer 13 is different due to the influence of light reflection and permeation by the protective layer 114, compared to a configuration that does not include the protective layer 114.

Note that, as the tack-containing coating and the ink forming the protective layer 114, arbitrary ink such as ultraviolet curing ink, and an organic solvent type of ink can be used.

Further, as the decoration member 13*a*, for example, metallic powder such as gold powder, luminous powder, isinglass powder, powdery fiber and the like can be used.

Note that the member adhering decoration method according to the present embodiment is configured to form the protective layer 114 by ink jet printing in the protective layer forming step; however, a curing composite resin may be dripped in a heap in the protective layer forming step to form the protective layer.

Figure 6A:
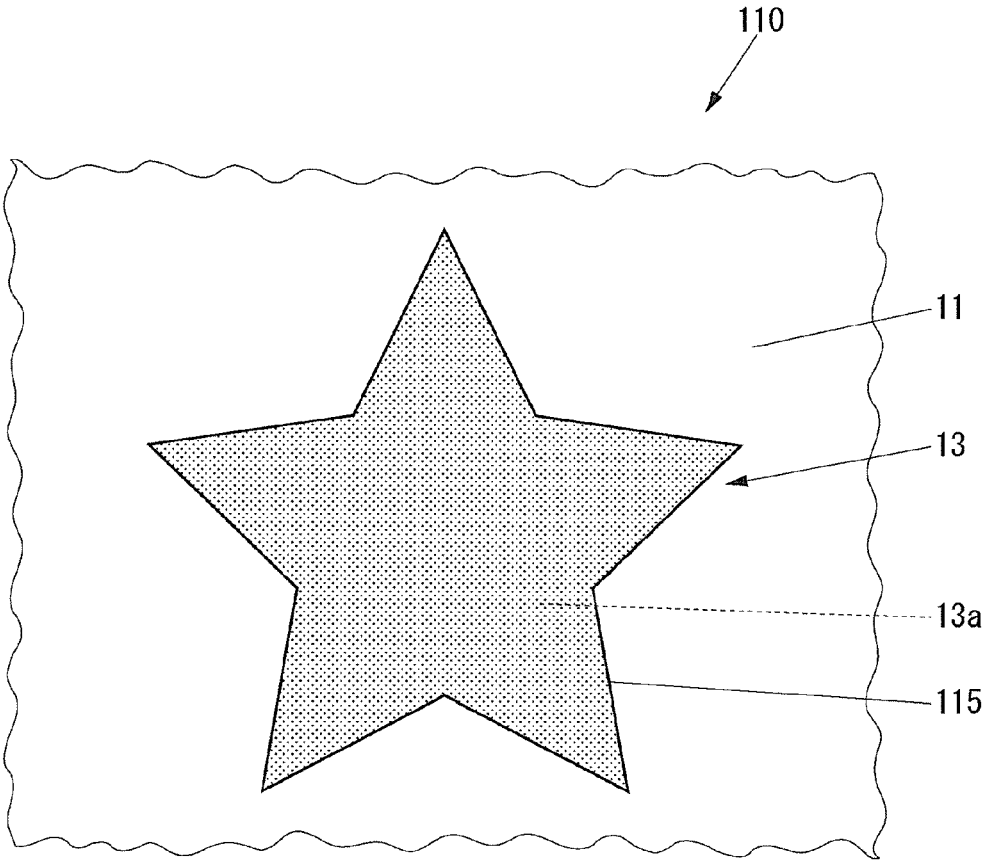
FIG. 6A is a front diagram of a part of the member adhering type decorated object according to the third embodiment of the present invention in an example different from the example shown in FIG. 5A and FIG. 5B.
Figure 6B:
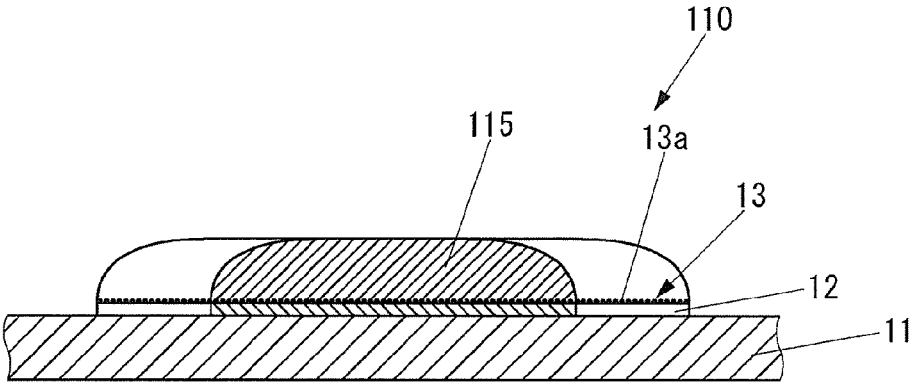
FIG. 6B is a bottom surface cross sectional diagram of a part of the member adhering type decorated object shown in FIG. 6A.

FIG. 6A is a front diagram of a part of the member adhering type decorated object 110 according to the present embodiment in an example different from the example shown in FIG. 5A and FIG. 5B. FIG. 6B is a bottom surface cross sectional diagram of a part of the member adhering type decorated object 110 shown in FIG. 6A.

A configuration of the member adhering type decorated object 110 shown in FIG. 6A and FIG. 6B is similar to a configuration in which the member adhering type decorated object 10 includes a protective layer 115 for protecting the decoration layer 13.

The protective layer 115 is formed by dipping a curing composite resin in a heap on the decoration layer 13 and thereafter curing this composite resin. This composite resin is, for example, a colorless and transparent composite resin.

In a case where the member adhering decoration method according to the present embodiment is configured to form the protective layer 115 by dripping the curing composite resin in a heap, decoration of a heap of the composite resin can newly be added to the member adhering type decorated object 110 by using the protective layer 115 protecting the decoration layer 13, compared to the case of forming the protective layer 114 by ink jet printing.

In the member adhering type decorated object 110, appearance of the decoration layer 13 is different due to the influence of light reflection and permeation by the protective layer 115, compared to a configuration that does not include the protective layer 115 and the configuration that includes the protective layer 114.

Note that, as a method of dripping the curing composite resin in a heap, there are a method of manually dripping the composite resin by the worker, a method of dripping the composite resin by a dedicated device, and the like.

Fourth Embodiment

Firstly, a configuration of a member adhering type decorated object according to the present embodiment will be described.

Note that, as for a configuration similar to the configuration of the member adhering type decorated object 10 according to the first embodiment (see FIG. 1A and FIG. 1B) among the configurations of the member adhering type decorated object according to the present embodiment, the same reference numerals as those in the configuration of the member adhering type decorated object 10 will be given and a detailed description thereof will be omitted.

Figure 7A:
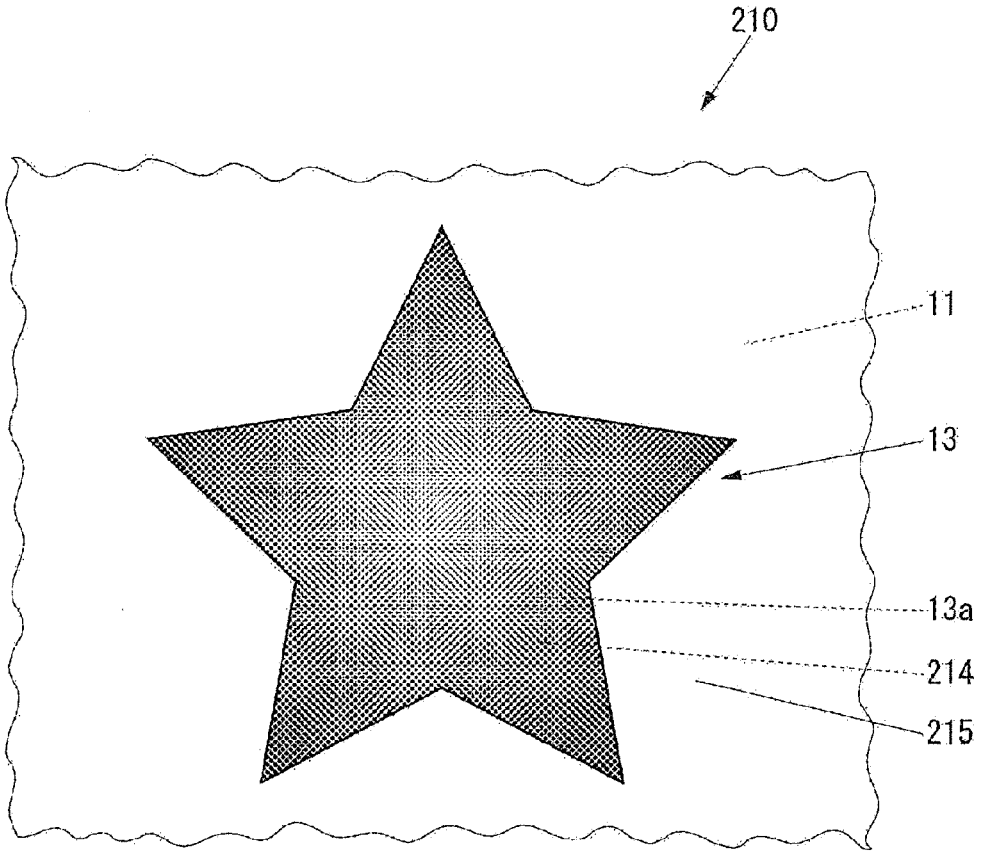
FIG. 7A is a front diagram of a part of a member adhering type decorated object according to a fourth embodiment of the present invention.
Figure 7B:
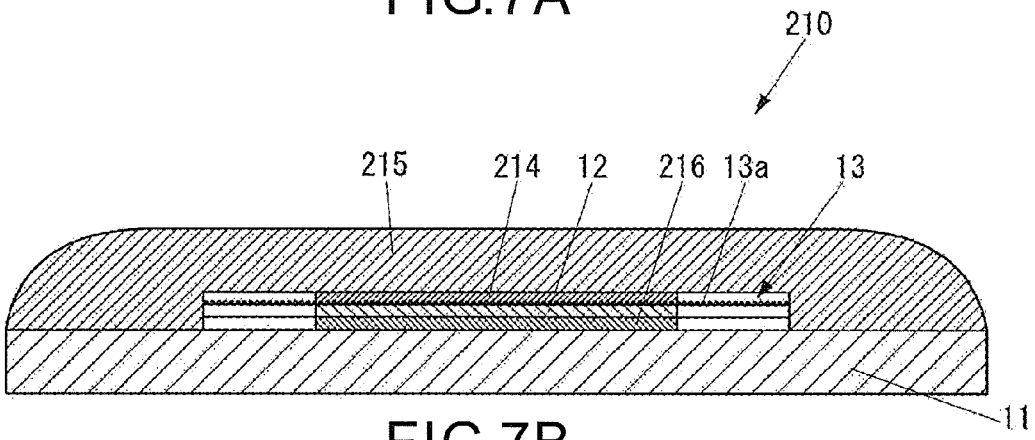
FIG. 7B is a bottom surface cross sectional diagram of a part of the member adhering type decorated object shown in FIG. 7A.

FIG. 7A is a front diagram of a part of a member adhering type decorated object 210 according to the present embodiment. FIG. 7B is a bottom surface cross sectional diagram of a part of the member adhering type decorated object 210 shown in FIG. 7A.

As shown in FIG. 7A and FIG. 7B, a configuration of the member adhering type decorated object 210 is similar to the configuration in which the member adhering type decorated object 10 includes a color layer 214 as a protective layer for protecting a decoration layer 13, a heaped layer 215 as a protective layer for protecting the decoration layer 13, and a white layer 216 provided between a target object 11 and a primer layer 12.

The color layer 214 is formed by UV ink jet printing ultraviolet curing ink on the decoration layer 13. This ink is color ink.

The heaped layer 215 is formed by dipping a curing composite resin in a heap on the color layer 214 and thereafter curing this composite resin. This composite resin is, for example, a colorless and transparent composite resin.

The white layer 216 is formed by UV ink jet printing ultraviolet curing ink on the target object 11. This ink is white ink.

Note that a decoration member 13*a* of the decoration layer 13 is metallic powder such as gold powder, and silver powder.

Next, a member adhering decoration method that decorates the target object 11 by sowing the decoration member 13*a* on the target object 11, that is, a method of manufacturing the member adhering type decorated object 210 will be described.

As will be described below, a worker creates print data used in a white layer forming step, a primer layer forming step, and a color layer forming step to be described later.

Figure 8A:
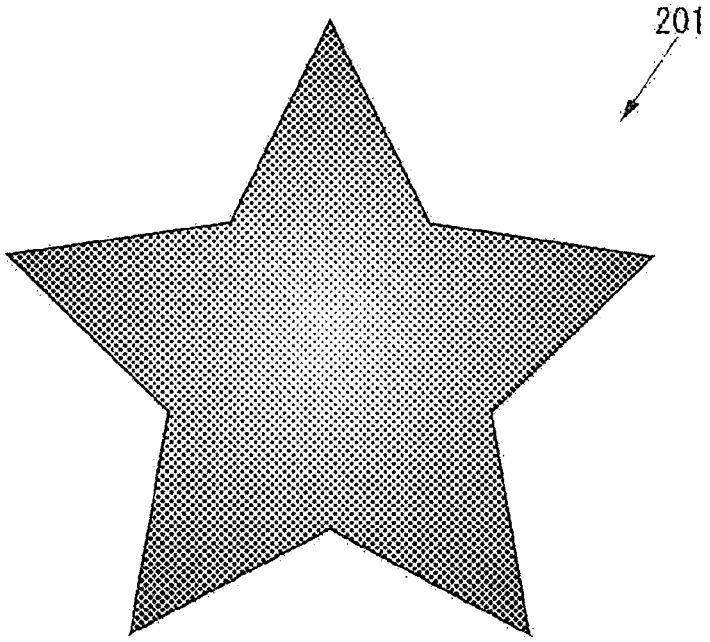
FIG. 8A is a diagram showing an image based on print data used in a color layer forming step in a method of manufacturing the member adhering type decorated object shown in FIG. 7A and FIG. 7B.
Figure 8B:
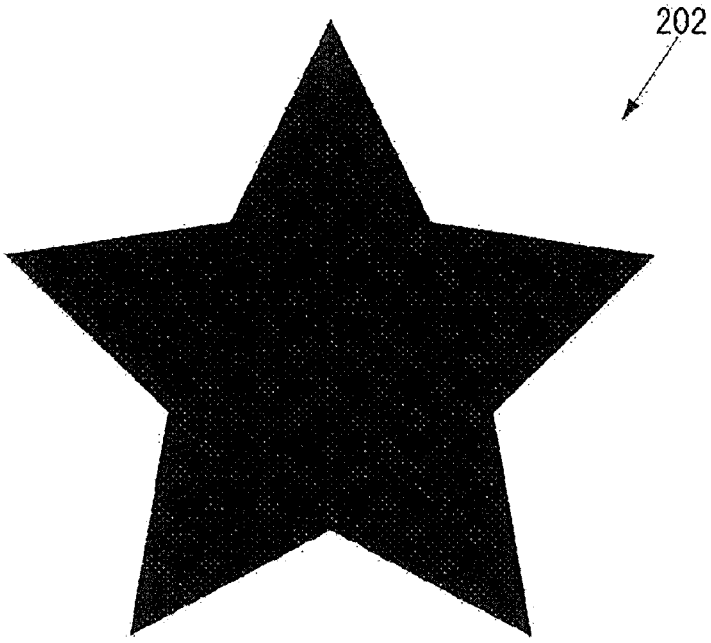
FIG. 8B is a diagram showing an image based on print data used in a white layer forming step and a primer layer forming step in the method of manufacturing the member adhering type decorated object shown in FIG. 7A and FIG. 7B.

FIG. 8A is a diagram showing an image 201 based on the print data used in the color layer forming step in the method of manufacturing the member adhering type decorated object 210. FIG. 8B is a diagram showing an image 202 based on the print data used in the white layer forming step and the primer layer forming step in the method of manufacturing the member adhering type decorated object 210.

Firstly, the worker uses a computer such as a PC (Personal Computer) to create color print data for printing the image 201 shown in FIG. 8A.

Next, the worker uses an image processing program executed in the computer to generate black and white print data for printing the image 202 shown in FIG. 8B by converting the colors of the image 201 shown in FIG. 8A to a single color of black. Accordingly, the print data of the image 201 and the print data of the image 202 are print data in which outer shapes of figures to be printed are identical.

The worker performs the work as described below after having created the print data as described above.

1. White Layer Forming Step

The worker fixes the target object 11 at a predetermined position on a table 21 of an ink jet printer 20, and instructs the ink jet printer 20 to record an image based on the print data of the image 202 (see FIG. 8B) on the target object 11 with ultraviolet curing white ink.

The ink jet printer 20 that has received the instruction from the worker moves a carriage 24 relative to the target object 11 fixed on the table 21 in accordance with the print data of the image 202 as described above. Then, the ink jet printer 20 discharges the ultraviolet curing white ink from a recording head on the carriage 24 toward the target object 11 fixed on the table 21, and irradiates the ultraviolet curing white ink discharged on the target object 11 with the ultraviolet ray by the LED on the carriage 24. That is, the ink jet printer 20 UV ink jet prints the ultraviolet curing white ink on the target object 11 in a form of the image 202 based on the print data, and forms the white layer 216 of the ultraviolet curing white ink on the target object 11.

Figure 9A:
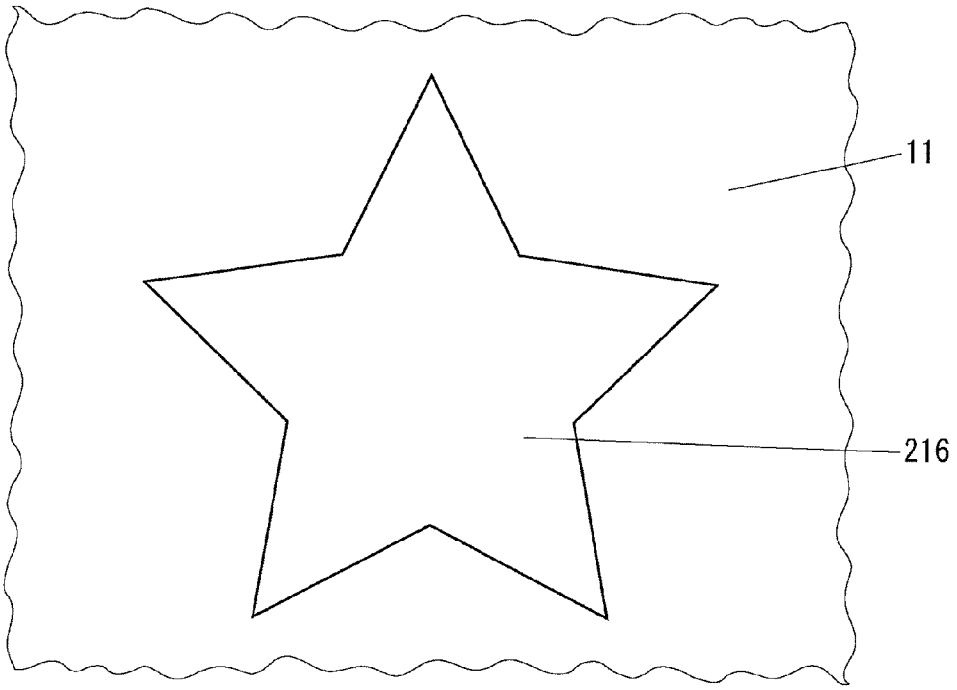
FIG. 9A is a front diagram of a part of the target object shown in FIG. 7A and FIG. 7B in which a white layer is formed.
Figure 9B:
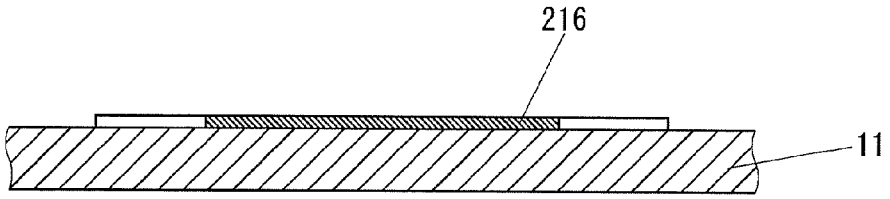
FIG. 9B is a bottom surface cross sectional diagram of a part of the target object shown in FIG. 9A.

FIG. 9A is a front diagram of a part of the target object 11 in which the white layer 216 is formed. FIG. 9B is a bottom surface cross sectional diagram of a part of the target object 11 shown in FIG. 9A.

The target object 11 in which the white layer 216 is formed in the white layer forming step becomes as shown in FIG. 9A and FIG. 9B, for example.

2. Primer Layer Forming Step

Next, the worker instructs the ink jet printer 20 to record print data that is identical to the print data used in the above-described white layer forming step, that is, an image based on the print data of the image 202 (see FIG. 8B) on the target object 11 with tack-containing coating while the target object 11 in which the white layer 216 is formed is kept fixed at the same position as the position in the white layer forming step on the table 21 of the ink jet printer 20.

The ink jet printer 20 that has received the instruction from the worker moves the carriage 24 relative to the target object 11 fixed on the table 21 in accordance with the print data of the image 202, as described above. Then, the ink jet printer 20 discharges the tack-containing coating from the recording head on the carriage 24 toward the target object 11 fixed on the table 21, and irradiates the tack-containing coating discharged on the target object 11 with the ultraviolet ray by the LED on the carriage 24. That is, the ink jet printer 20 forms the primer layer 12 of the tack-containing coating on the white layer 216 by UV ink jet printing the tack-containing coating in the form of the image 202 based on the print data on the target object 11.

Figure 10A:
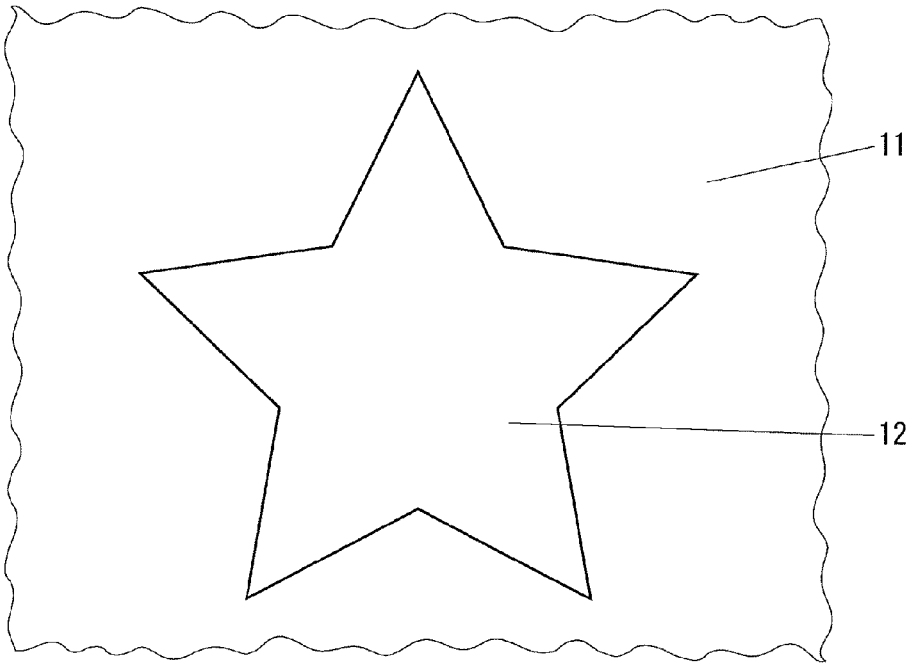
FIG. 10A is a front diagram of a part of the target object shown in FIG. 7A and FIG. 7B in which a primer layer is formed on a white layer.
Figure 10B:
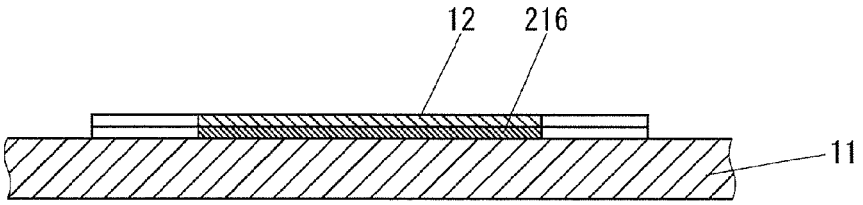
FIG. 10B is a bottom surface cross sectional diagram of a part of the target object shown in FIG. 10A.

FIG. 10A is a front diagram of a part of the target object 11 in which the primer layer 12 is formed on the white layer 216. FIG. 10B is a bottom surface cross sectional diagram of a part of the target object 11 shown in FIG. 10A.

The target object 11 in which the primer layer 12 is formed in the primer layer faulting step becomes as shown in FIG. 10A and FIG. 10B, for example.

3. Decoration Layer Forming Step

Next, the worker forms the decoration layer 13 of the decoration member 13*a* on the primer layer 12 by the tack of the primer layer 12 by sowing the decoration member 13*a* on the primer layer 12 formed on the target object 11, in a similar manner to the first embodiment.

Note that the worker can improve adherence of the primer layer 12 and the decoration member 13*a* by pressing the decoration member 13*a* with a sponge and the like and sowing the decoration member on the primer layer 12.

Further, the worker can prevent the decoration member 13*a* from remaining on portions other than the primer layer 12 on the target object 11 by scrubbing the target object 11 with a sponge and the like, washing the target object 11 with water and the like, or blowing air on the target object 11 with an air brush and the like after having sowed the decoration member 13*a* on the primer layer 12.

Figure 11A:
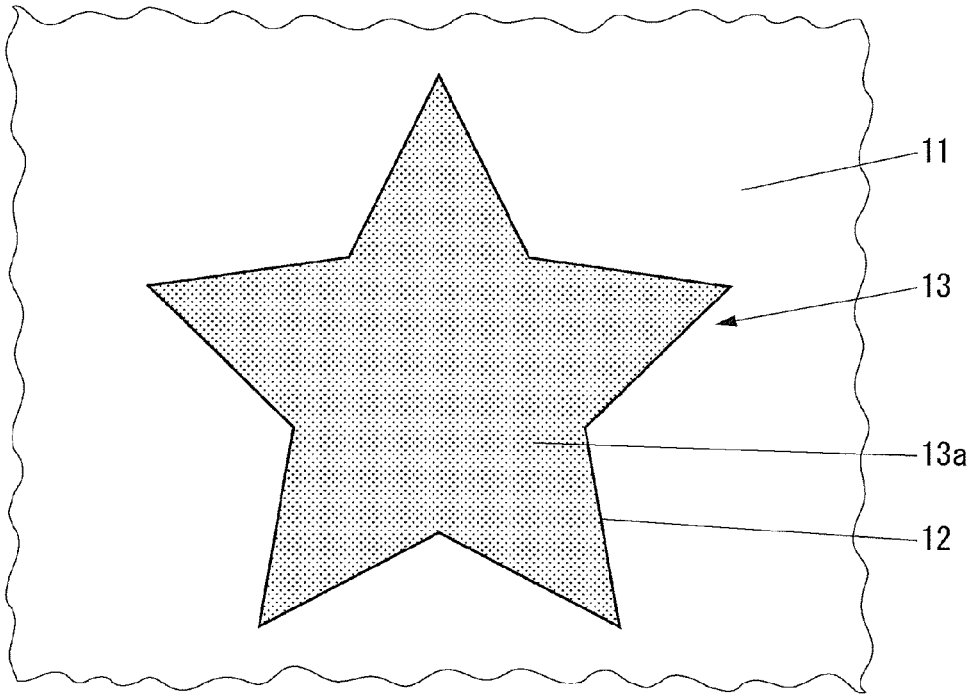
FIG. 11A is a front diagram of a part of the target object shown in FIG. 7A and FIG. 7B in which a decoration layer is formed on a primer layer.
Figure 11B:
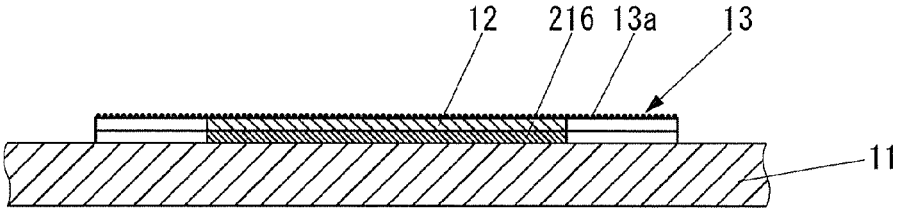
FIG. 11B is a bottom surface cross sectional diagram of a part of the target object shown in FIG. 11A.

FIG. 11A is a front diagram of a part of the target object 11 in which the decoration layer 13 is formed on the primer layer 12. FIG. 11B is a bottom surface cross sectional diagram of a part of the target object 11 shown in FIG. 11A.

The target object 11 in which the decoration layer 13 is formed in the decoration layer forming step becomes as shown in FIG. 11A and FIG. 11B, for example.

4. Color Layer Forming Step (Protective Layer Forming Step)

Next, the worker fixes the target object 11 in which the decoration layer 13 is formed at the same position as the position in the primer layer forming step on the table 21 of the ink jet printer 20, and instructs the ink jet printer 20 to record an image based on the print data of the image 201 (see FIG. 8A) on the target object 11 with ultraviolet curing color ink.

The ink jet printer 20 that has received the instruction from the worker moves the carriage 24 relative to the target object 11 fixed on the table 21 in accordance with the print data of the image 201 as described above. Then, the ink jet printer 20 discharges the ultraviolet curing color ink from the recording head on the carriage 24 toward the target object 11 fixed on the table 21, and irradiates the ultraviolet curing color ink discharged on the target object 11 with the ultraviolet ray by the LED on the carriage 24. That is, the ink jet printer 20 forms the color layer 214 on the decoration layer 13 of the ultraviolet curing color ink by UV ink jet printing the ultraviolet curing color ink in a form of the image 201 based on the print data on the decoration layer 13.

Figure 12A:
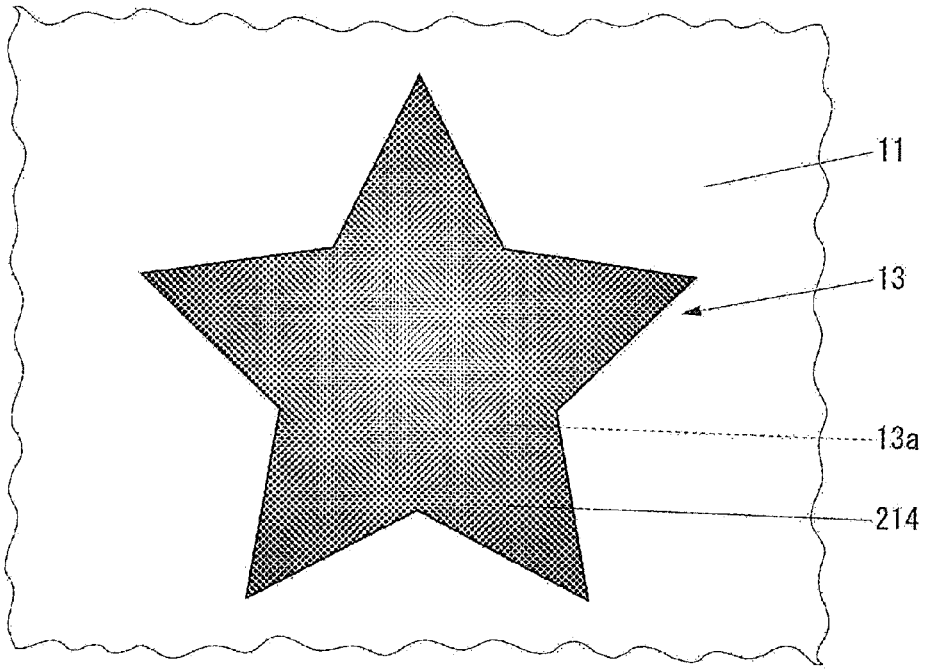
FIG. 12A is a front diagram of a part of the target object shown in FIG. 7A and FIG. 7B in which a color layer is formed on a decoration layer.
Figure 12B:
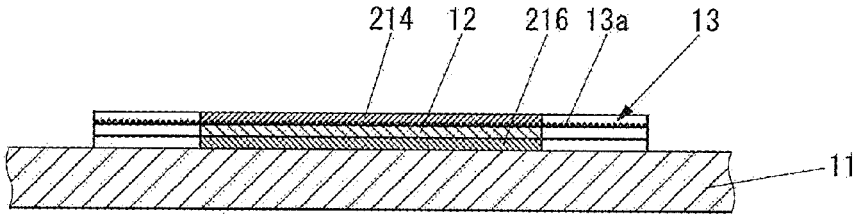
FIG. 12B is a bottom surface cross sectional diagram of a part of the target object shown in FIG. 12A.

FIG. 12A is a front diagram of a part of the target object 11 in which the color layer 214 is formed on the decoration layer 13. FIG. 12B is a bottom surface cross sectional diagram of a part of the target object 11 shown in FIG. 12A.

The target object 11 in which the color layer 214 is formed in the color layer forming step becomes as shown in FIG. 12A and FIG. 12B, for example.

5. Heaped Layer Forming Step (Protective Layer Forming Step)

Next, the worker forms the heaped layer 215 of a composite resin on the target object 11 by dripping the curing composite resin in a heap on an entire surface on which the color layer 214 is formed of the target object 11 in which the color layer 214 is formed.

The target object 11 in which the heaped layer 215 is formed in the heaped layer forming step is completed as the member adhering type decorated object 210 as shown in FIG. 7A and FIG. 7B, for example.

As described above, since the member adhering decoration method according to the present embodiment causes the decoration member 13*a* to adhere onto the primer layer 12 by the tack (viscosity) of the primer layer 12 after having completely cured the primer layer 12, management of time for causing the decoration member 13*a* to adhere can be facilitated compared to the related art. That is, the member adhering decoration method according to the present embodiment can improve the workability compared to the related art.

Further, since the member adhering decoration method according to the present embodiment forms the primer layer 12 of the tack-containing coating on the target object 11 by UV ink jet printing the tack-containing coating on the target object 11, the time to the curing of the primer layer 12 can be shortened. Accordingly, the member adhering decoration method according to the present embodiment can shorten the time to the completion of the member adhering type decorated object 210 generated by causing the decoration member 13*a* to adhere to the target object 11.

Further, since the member adhering decoration method according to the present embodiment protects the decoration layer 13 by the color layer 214 and the heaped layer 215, durability of the member adhering type decorated object 210 can be improved.

Further, since the member adhering decoration method according to the present embodiment covers the primer layer 12 having the tack with the color layer 214 and the heaped layer 215, the method can prevent the member adhering type decorated object 210 from fouling with dust adhering onto the primer layer 12.

Further, since the member adhering decoration method according to the present embodiment forms the color layer 214 by ink jet printing, the color layer 214 can easily be formed compared to the case of manually forming the color layer 214 by the worker.

In the member adhering type decorated object 210, the appearance of the decoration layer 13 is different due to the influence of light reflection and permeation by the color layer 214, compared to a configuration that does not include the color layer 214. That is, the member adhering decoration method according to the present embodiment not only can improve the durability of the member adhering type decorated object 210 by protecting the decoration layer 13 by the color layer 214, but also can newly add bright decoration providing a synergistic effect of the decoration layer 13 of the decoration member 13*a* and the color layer 214 having the light permeability to the member adhering type decorated object 210.

Further, in the member adhering decoration method according to the present embodiment, since an outer shape of the primer layer 1 formed by ink jet printing in the primer layer forming step and an outer shape of the color layer 214 formed by ink jet printing in the color layer forming step become identical, the decoration layer 13 formed on the primer layer 12 and the color layer 214 having the light permeability can be overlapped with high accuracy.

Since the member adhering decoration method according to the present embodiment forms the heaped layer 215 by dripping the curing composite resin in a heap, decoration of a heap of the composite resin can newly be added to the member adhering type decorated object 210 by using the heaped layer 215 protecting the decoration layer 13.

In the member adhering type decorated object 210, the appearance of the decoration layer 13 is different due to the influence of light reflection and permeation by the heaped layer 215, compared to a configuration that does not include the heaped layer 215.

Note that, as a method of dripping the curing composite resin in a heap, there are a method of manually dripping the composite resin by the worker, a method of dripping the composite resin by a dedicated device, and the like.

Since the member adhering decoration method according to the present embodiment forms the white layer 216 under the decoration layer 13 and the color layer 214, the coloring of the decoration layer 13 and the color layer 214 can be improved even when the color of the target object 11 is, for example, black.

Note that, as the tack-containing coating, the ink forming the color layer 214, and the ink forming the white layer 216, arbitrary ink such as ultraviolet curing ink, and an organic solvent type of ink can be used.

Further, as the decoration member 13*a*, other than the metallic powder, for example, luminous powder, isinglass powder, powdery fiber and the like can be used.

Note that the member adhering decoration method according to the present embodiment is configured to form the heaped layer 215 in the heaped layer forming step, but may be configured not to form the heaped layer 215 by omitting the heaped layer forming step.

Figure 13A:
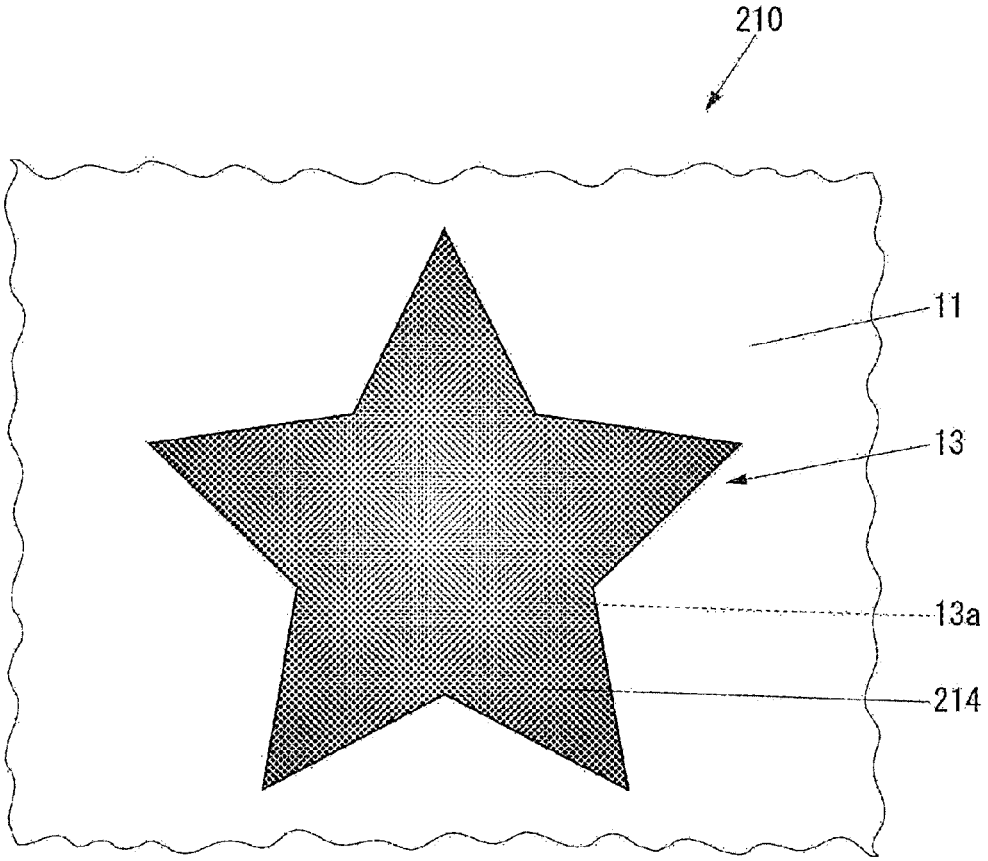
FIG. 13A is a front diagram of a part of the member adhering type decorated object according to the fourth embodiment of the present invention in an example different from the example shown in FIG. 7A and FIG. 7B.
Figure 13B:
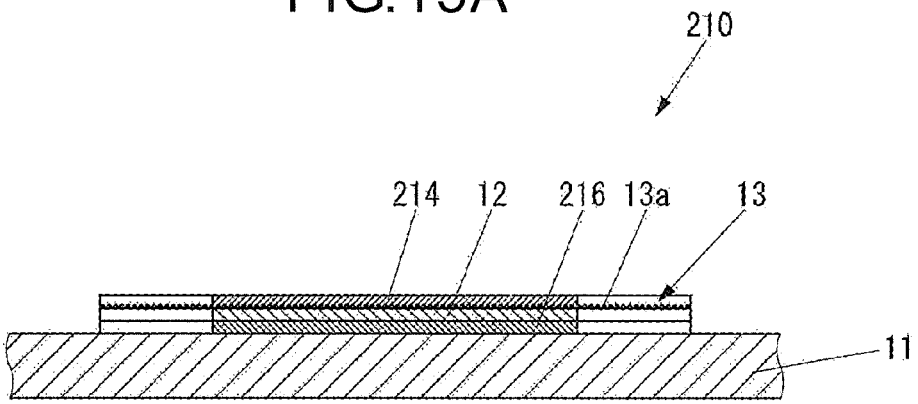
FIG. 13B is a bottom surface cross sectional diagram of a part of the member adhering type decorated object shown in FIG. 13A.

FIG. 13A is a front diagram of a part of the member adhering type decorated object 210 according to the present embodiment in an example different from the example shown in FIG. 7A and FIG. 7B. FIG. 13B is a bottom surface cross sectional diagram of a part of the member adhering type decorated object 210 shown in FIG. 13A.

A configuration of the member adhering type decorated object 210 shown in FIG. 13A and FIG. 13B is similar to a configuration in which the member adhering type decorated object 210 shown in FIG. 7A and FIG. 7B does not include the heaped layer 215.

Further, the member adhering decoration method according to the present embodiment is configured to form the white layer 216 in the white layer forming step, but may be configured not to form the white layer 216 by omitting the white layer forming step.

Figure 14A:
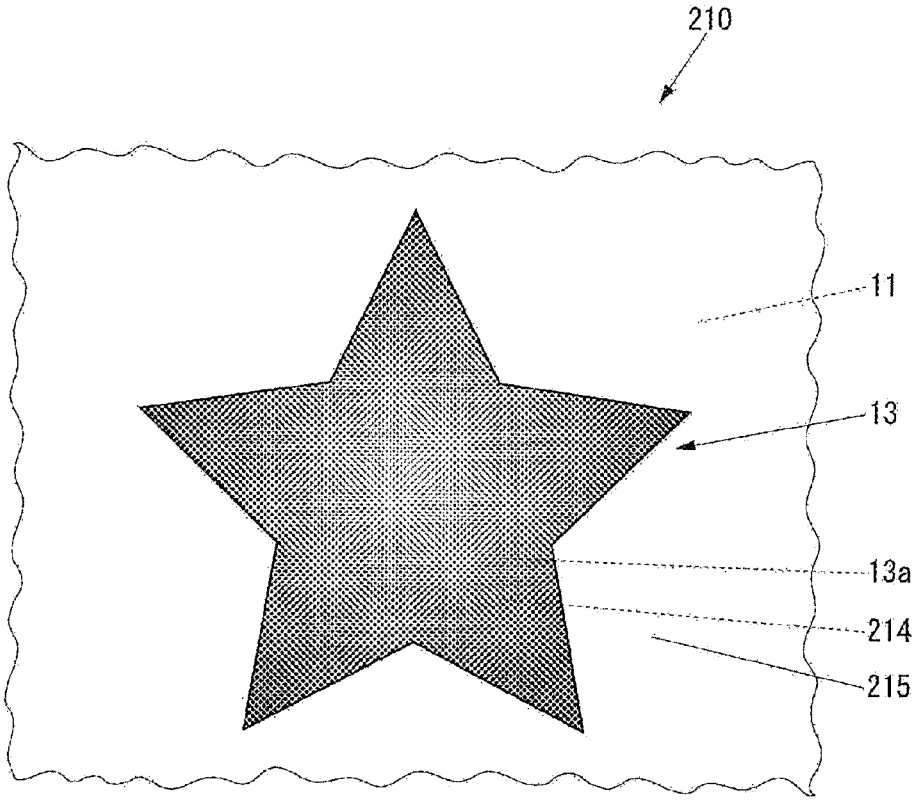
FIG. 14A is a front diagram of a part of the member adhering type decorated object according to the fourth embodiment of the present invention in an example different from the examples shown in FIG. 7A, FIG. 7B, FIG. 13A, and FIG. 13B.
Figure 14B:
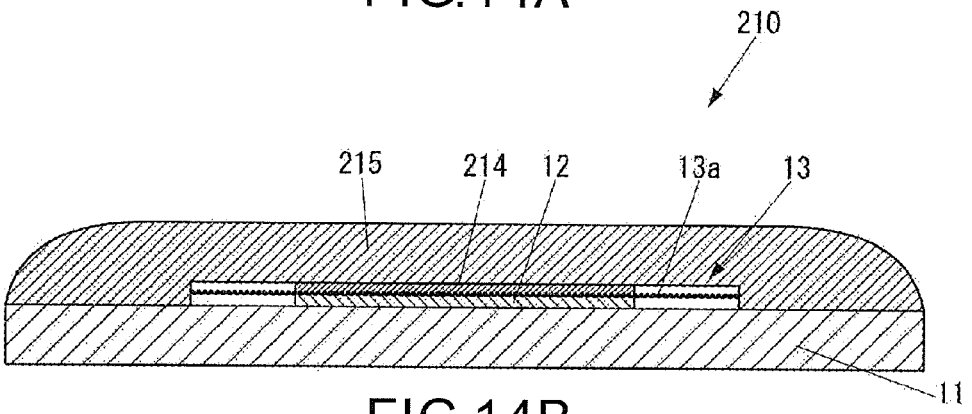
FIG. 14B is a bottom surface cross sectional diagram of a part of the member adhering type decorated object shown in FIG. 14A.

FIG. 14A is a front diagram of a part of the member adhering type decorated object 210 according to the present embodiment in an example different from the examples shown in FIG. 7A, FIG. 7B, FIG. 13A, and FIG. 13B. FIG. 14B is a bottom surface cross sectional diagram of a part of the member adhering type decorated object 210 shown in FIG. 14A.

A configuration of the member adhering type decorated object 210 shown in FIG. 14A and FIG. 14B is similar to a configuration in which the member adhering type decorated object 210 shown in FIG. 7A and FIG. 7B does not include the white layer 216. That is, the member adhering type decorated object 210 shown in FIG. 7A and FIG. 7B has the primer layer 12 formed on the target object 11 via the white layer 216; however, the member adhering type decorated object 210 shown in FIG. 14A and FIG. 14B has the primer layer 12 directly formed on the target object 11.

Moreover, the member adhering decoration method according to the present embodiment may be configured not to form the heaped layer 215 and the white layer 216 by omitting the white layer forming step and the heaped layer forming step.

Figure 15A:
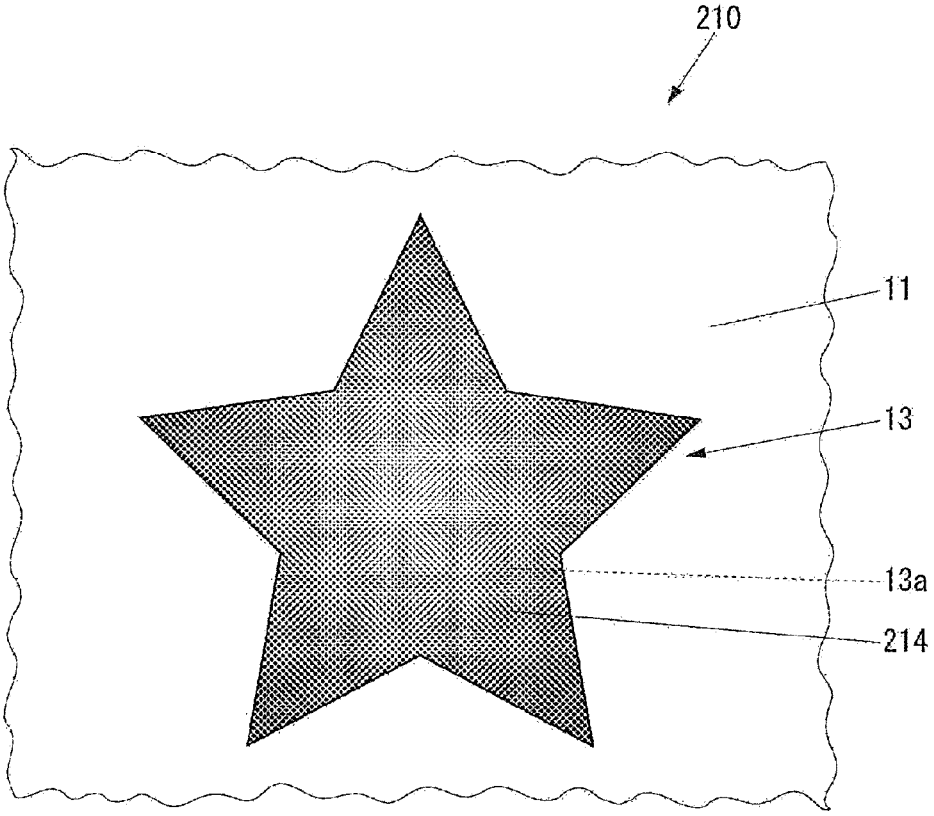
FIG. 15A is a front diagram of a part of the member adhering type decorated object according to the fourth embodiment of the present invention in an example different from the examples shown in FIG. 7A, FIG. 7B, FIG. 13A, FIG. 13B, FIG. 14A, and FIG. 14B.
Figure 15B:
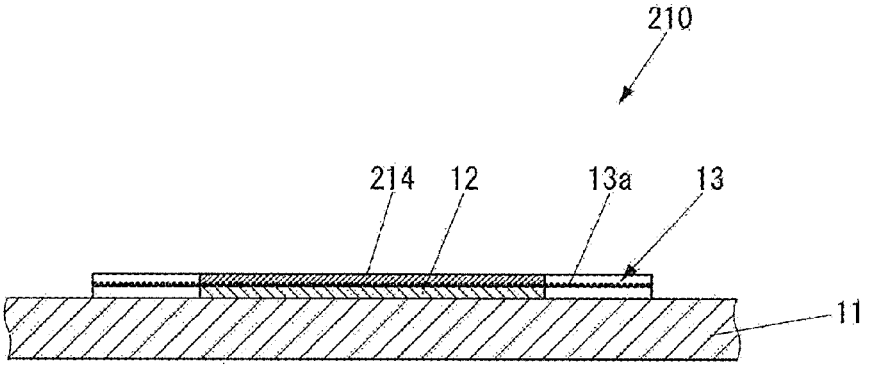
FIG. 15B is a bottom surface cross sectional diagram of a part of the member adhering type decorated object shown in FIG. 15A.

FIG. 15A is a front diagram of a part of the member adhering type decorated object 210 according to the present embodiment in an example different from the examples shown in FIG. 7A, FIG. 7B, FIG. 13A, FIG. 13B, FIG. 14A, and FIG. 14B. FIG. 15B is a bottom surface cross sectional diagram of a part of the member adhering type decorated object 210 shown in FIG. 15A.

A configuration of the member adhering type decorated object 210 shown in FIG. 15A and FIG. 15B is similar to a configuration in which the member adhering type decorated object 210 shown in FIG. 7A and FIG. 7B does not include the heaped layer 215 and the white layer 216.

Since the member adhering decoration method according to each of the above-described embodiments forms the decoration layer 13 by simple work of sowing the decoration member 13*a* on the primer layer 12, the workability can be improved. However, the member adhering decoration method according to each of the above-described embodiments may be configured to cause the decoration member 13*a* to adhere onto the primer layer 12 by a method other than the sowing.

The invention claimed is:

1. A member adhering decoration method for decorating a target object by adhering a decoration member, which is a member for decoration, onto the target object, the method comprising:

a primer layer forming step for ink jet printing a tack-containing coating having a tack after curing, onto the target object, to form a primer layer on the target object by using the tack-containing coating; and a decoration layer forming step for applying the decoration member onto the primer layer formed by the primer layer forming step after curing, wherein a decoration layer composed of the decoration member is formed on the primer layer using the tack of the primer layer;

wherein the tack-containing coating is an ultraviolet curing coating;

the primer layer forming step is a step of forming the primer layer on the target object by discharging the tack-containing coating onto the target object, along with irradiating the discharged tack-containing coating by UV ink jet printing; and the decoration layer forming step is a step of sowing the decoration member on the primer layer using the tack of the primer layer in a state where the primer layer does not spread on the target object by its own weight or wettability.

2. The member adhering decoration method according to claim 1, comprising: a primer layer heating step for heating the primer layer on which the decoration layer is formed in the decoration layer forming step, to a temperature equal to or greater than a glass transition point of the primer layer.

3. The member adhering decoration method according to claim 1, comprising:

a primer layer heating step for heating the primer layer on which the decoration layer is formed in the decoration layer forming step, to a temperature equal to or greater than a glass transition point of the primer layer; and a decoration layer pressing step for pressing the decoration layer against the primer layer after the primer layer heating step, at a time point when the temperature of the primer layer is equal to or greater than the glass transition point.

4. The member adhering decoration method according to claim 1, comprising: a protective layer forming step for forming a protective layer that protects the decoration layer formed in the decoration layer forming step, on the decoration layer.

5. The member adhering decoration method according to claim 4, wherein the protective layer forming step is a step of forming the protective layer by ink jet printing.

6. The member adhering decoration method according to claim 5, wherein the protective layer forming step is a step of forming the protective layer having light permeability by color ink jet printing.

7. The member adhering decoration method according to claim 6, wherein print data used in the ink jet printing in the primer layer forming step and print data used in the ink jet printing in the protective layer forming step are print data in which outer shapes of figures to be printed are identical.

8. The member adhering decoration method according to claim 4, wherein the protective layer forming step is a step of forming the protective layer by dripping a curing composite resin in a heap.

9. The member adhering decoration method according to claim 1, wherein the decoration member is a fiber.

* * * * *